US007246969B2

(12) United States Patent
Orser

(10) Patent No.: US 7,246,969 B2
(45) Date of Patent: Jul. 24, 2007

(54) STORM DRAIN INLET

(76) Inventor: Carl E. Orser, 6124 Merriam Dr., Merriam, KS (US) 66203

( * ) Notice: Subject to any disclaimer, the term of this patent is extended or adjusted under 35 U.S.C. 154(b) by 0 days.

(21) Appl. No.: 11/267,059

(22) Filed: Nov. 4, 2005

(65) Prior Publication Data

US 2007/0110514 A1 May 17, 2007

(51) Int. Cl.
*E01C 11/22* (2006.01)

(52) U.S. Cl. ..... 404/4; 404/2; 404/5

(58) Field of Classification Search ..... 404/2–5, 404/25, 70

See application file for complete search history.

(56) References Cited

U.S. PATENT DOCUMENTS

| | | | | | |
|---|---|---|---|---|---|
| 468,714 | A * | 2/1892 | Whitten | 404/4 |
| 603,561 | A * | 5/1898 | Gross | 404/4 |
| 623,108 | A * | 4/1899 | Rogers et al. | 210/164 |
| 642,530 | A * | 1/1900 | Robertson | 404/4 |
| 672,868 | A * | 4/1901 | Banwell | 404/4 |
| 714,185 | A * | 11/1902 | Jackson | 404/4 |
| 784,271 | A * | 3/1905 | McDonald | 404/4 |
| 1,696,237 | A * | 12/1928 | Hough | 404/4 |
| 1,998,514 | A * | 4/1935 | Miller | 404/4 |
| 2,037,926 | A * | 4/1936 | Robertson | 404/83 |
| 3,393,614 | A * | 7/1968 | Peletz | 404/4 |
| 3,876,322 | A * | 4/1975 | Deason | 404/2 |
| 4,844,403 | A | 7/1989 | Castle | |
| 5,795,467 | A * | 8/1998 | Schloss et al. | 210/162 |
| 6,015,489 | A * | 1/2000 | Allen et al. | 210/131 |
| 6,695,525 | B2 * | 2/2004 | Hirschhorn | 404/7 |

OTHER PUBLICATIONS

Photos of storm drain inlets.

* cited by examiner

*Primary Examiner*—Raymond Addie
(74) *Attorney, Agent, or Firm*—Mark E. Brown

(57) ABSTRACT

A storm drain inlet for a below-grade collection box including front, rear and side walls and a top. The inlet includes a pair of side columns, which connect to the collection box side walls. An upper crosspiece extends between the side columns and is attached to the collection box top. A lower crosspiece comprising a back plate extends between the side walls and provides a form for the rear edge of a concrete apron poured in front of the collection box. The side columns, upper crosspiece and concrete apron define an inlet throat open to the collection box interior. A roadway or parking lot structure can include curbs, which can be poured adjacent to the collection box into proximity with the inlet side columns. The curbs are preferably not rigidly connected to the inlet in order to accommodate relative movement therebetween. The inlet can be adapted for both poured-in-place and precast collection boxes. It can be scaled to accommodate various widths and heights.

10 Claims, 9 Drawing Sheets

STORM DRAIN INLET

BACKGROUND OF THE INVENTION

1. Field of the Invention

The present invention relates generally to storm drains, and in particular to a prefabricated inlet adapted for cast-in-place or precast storm drain collection boxes.

2. Description of the Related Art

Precipitation runoff is commonly collected and handled with storm drainage or storm sewer systems. Paved structures, such as roadways and parking lots, tend to generate relatively large volumes of runoff during precipitation events. They are commonly designed to gravity-drain relatively quickly for safety and to prevent flooding.

Roadways, parking lots and similar structures are commonly provided with storm drain collection boxes, which are installed below grade and collect runoff for discharge to underground storm sewer systems. Poured-in-place and precast concrete are commonly used for constructing storm drain collection boxes. The inlets for such collection boxes are typically located at the structures lowest elevations and are designed for receiving relatively large flow rates. Storm drain inlets have previously been made of poured concrete, which can be cast when the collection boxes are constructed. U.S. Pat. No. 4,844,183, which is assigned to me, shows a reusable form for storm sewer collection box inlets. However, forming and casting concrete inlets tended to be relatively labor-intensive.

Alternatively, relatively strong storm drain inlets can be efficiently prefabricated from steel plates using conventional steel manufacturing equipment and procedures. Steel provides considerable strength and can be galvanized or otherwise finished for weather-resistance.

Previous storm drain inlets were often rigidly attached to adjacent curbs by extending reinforcing steel between the collection boxes and the adjacent curb structures. Such rigid connections led to damage from shear and related forces. Storm drain inlets should preferably accommodate movement within certain design parameters relative to surrounding structures and terrain, including movement associated with settling and freeze-thaw cycles. Moreover, they should be adaptable to prefabrication and facilitate efficient and cost-effective construction. Scalability can also be an important consideration in storm drain inlet design because collection boxes of various widths can this be accommodated with a basic inlet design. Still further, inlets should preferably facilitate water flow into the collection boxes with minimal obstructions.

Heretofore there has not been available a storm drain inlet with the advantages and features of the present invention.

SUMMARY OF THE INVENTION

In the practice of the present invention, an inlet is provided for a collection box comprising a portion of a storm drainage system. The inlet includes side columns for placement on the walls of a collection box. The collection box can be poured-in-place on-site or precast for transport to and installation at the job site. The inlet includes upper and lower crosspieces extending between the end columns and defining an inlet opening. One or more intermediate or medial columns or dividers can optionally be provided whereby the inlet can be scaled to accommodate collection boxes of various widths and to provide inlet openings of different heights.

DETAILED DESCRIPTION OF THE PREFERRED EMBODIMENTS

Figure 1:
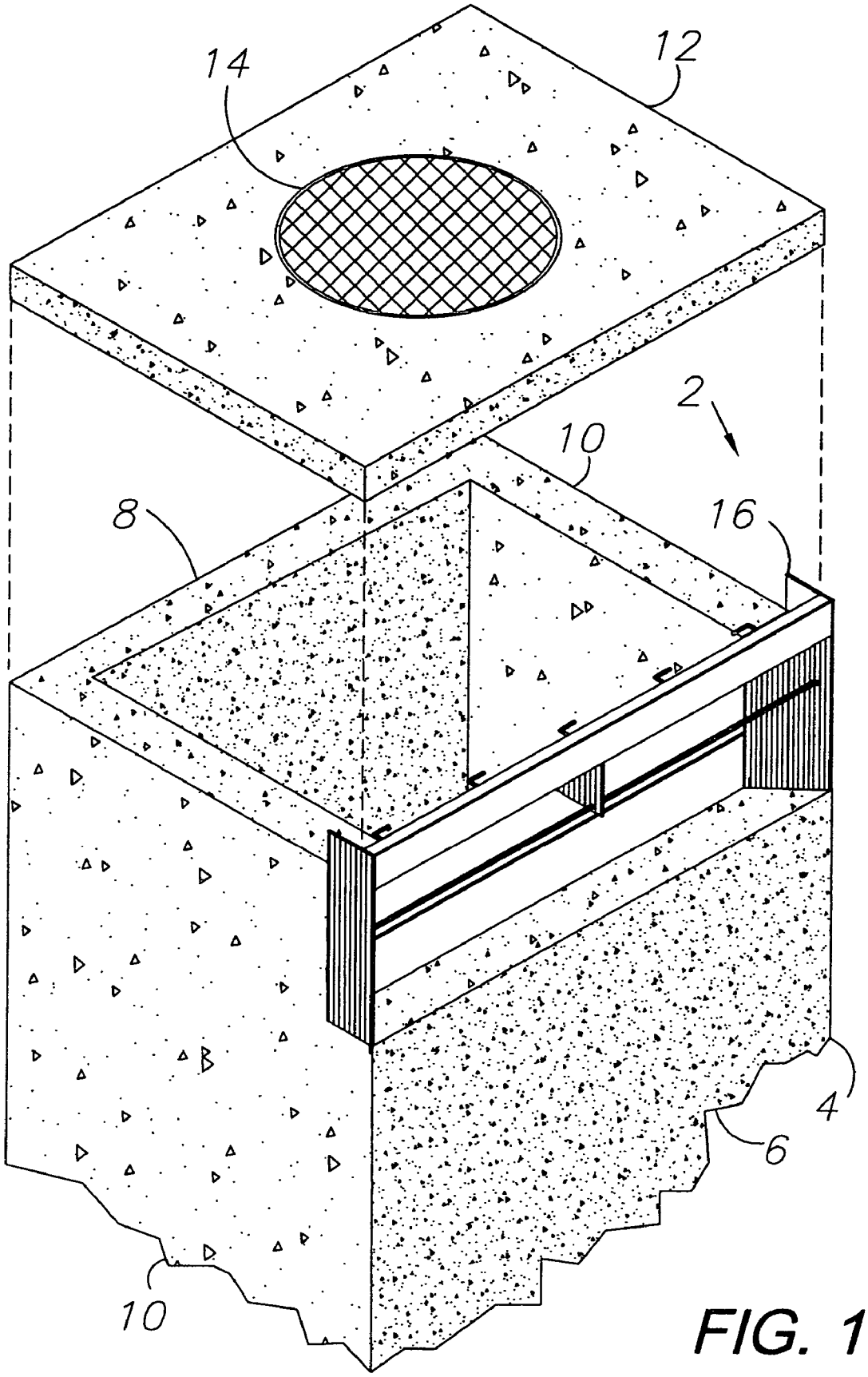
FIG. 1 is a perspective view of a storm drain collection box with a drain inlet embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, up, down, front, back, right and left refer to the invention as oriented in the view being referred to. The words "inwardly" and "outwardly" refer to directions toward and away from, respectively, the geometric center of the embodiment being described and designated parts thereof. Said terminology will include the words specifically mentioned, derivatives thereof and words of similar meaning.

Referring to the drawings in more detail, the reference numeral 2 generally designates a storm drain inlet for a collection box 4. Without limitation on the generality of useful applications of the inlet 2, the collection box 4 includes a front wall 6, a rear wall 8, opposite side walls 10 and a top 12 with a manhole 14. The collection box 4 described thus far is generally conventional. In a typical installation it would be installed below grade with its top 12 generally at ground level. The collection box 4 can be constructed primarily of steel-reinforced concrete using forms constructed on-site, or it can be precast with the inlet 2 installed prior to placement on site. Moreover, the inlet 2 can be retrofit to existing collection boxes.

The storm drain inlet 2 generally includes a pair of side columns 16, which are connected by upper and lower crosspieces 18, 20 extending generally transversely and horizontally therebetween. Each side column 16 includes upper and lower ends 21, 22, a full-height outside panel 24 with a rear edge 25 and a shorter inside panel 26 with a rear edge 27. The panels 24, 26 preferably form an acute dihedral angle across a fold or brake line 28, which defines a frontmost edge 30 of the side column 16. The outside panel 24 includes a top edge 31 at the side column upper end 21 and the inside panel 26 includes a downwardly-sloping top edge 32, which extends from a notch 34 in the outside panel 24 to the inside panel rear edge 27. Each inside panel 26 includes an elongated trash bar slot 29. A side column rear brace 36 extends between the panels 24, 26 adjacent to their respective rear edges 25, 27 and the side column lower end 22.

Figure 2:
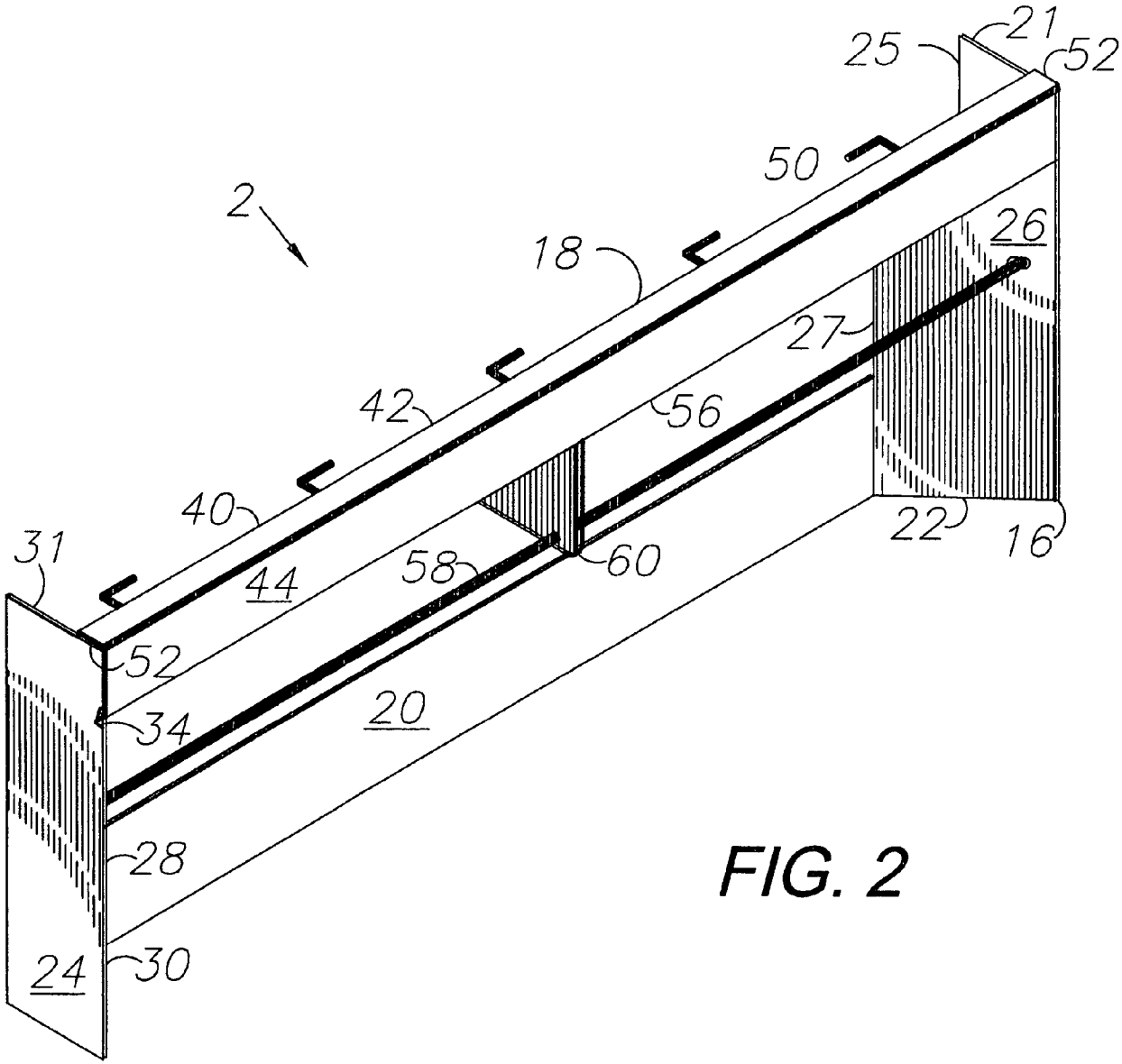
FIG. 2 is an upper, front, left-side perspective view of the drain inlet.
Figure 3:
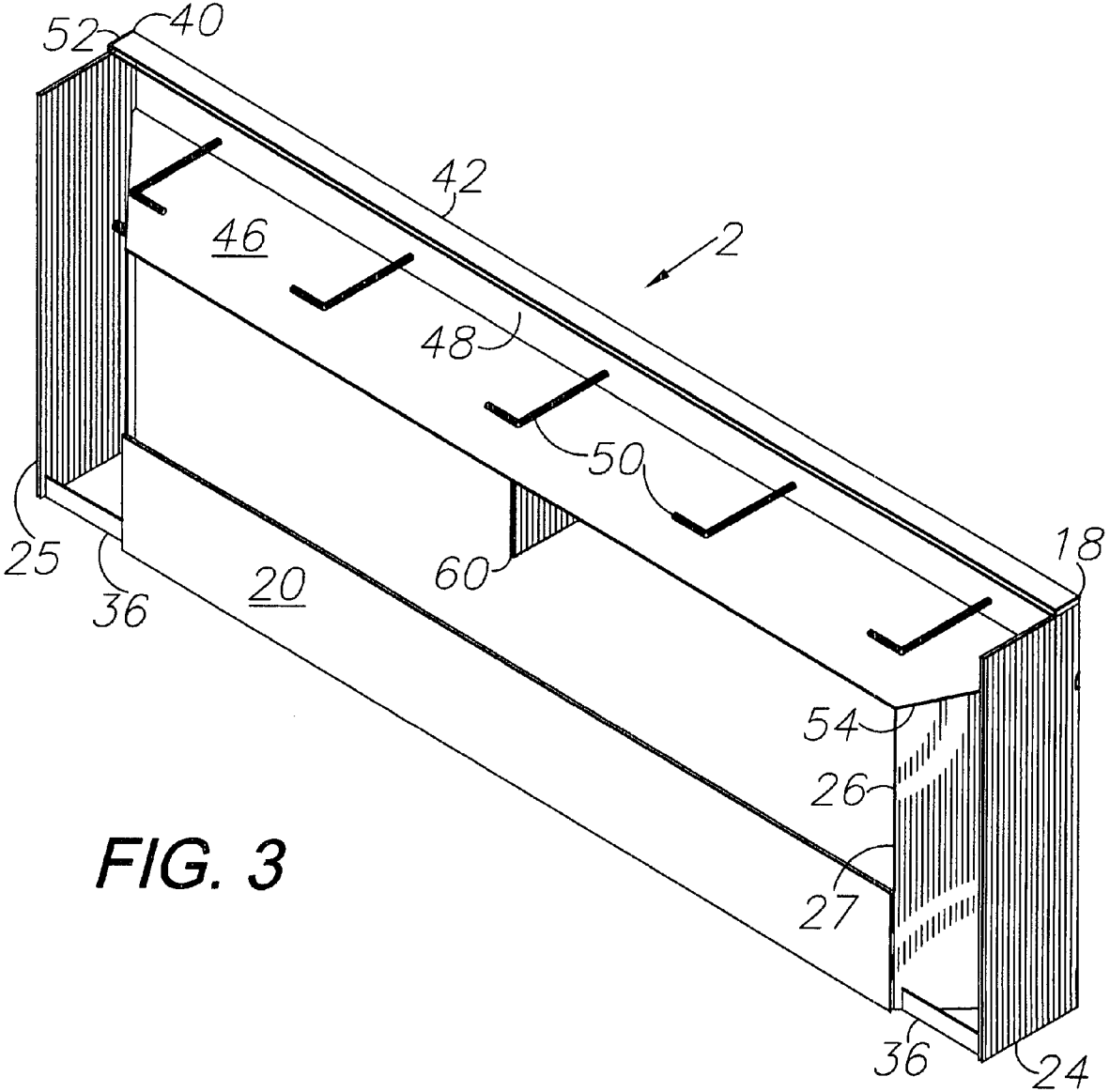
FIG. 3 is an upper, rear, left side perspective view thereof.
Figure 4:
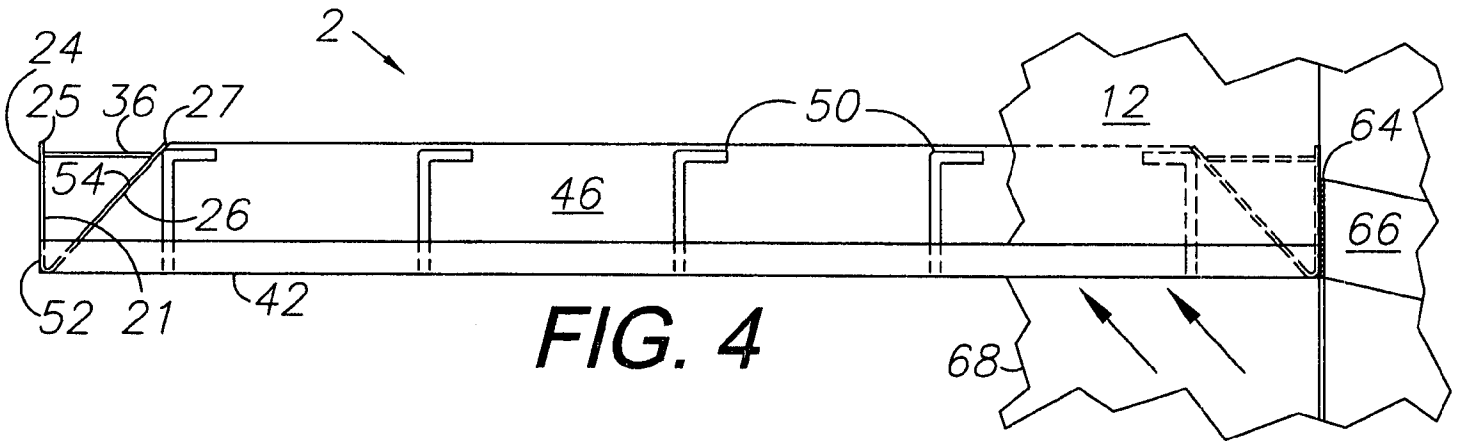
FIG. 4 is a top plan view thereof.
Figure 5:
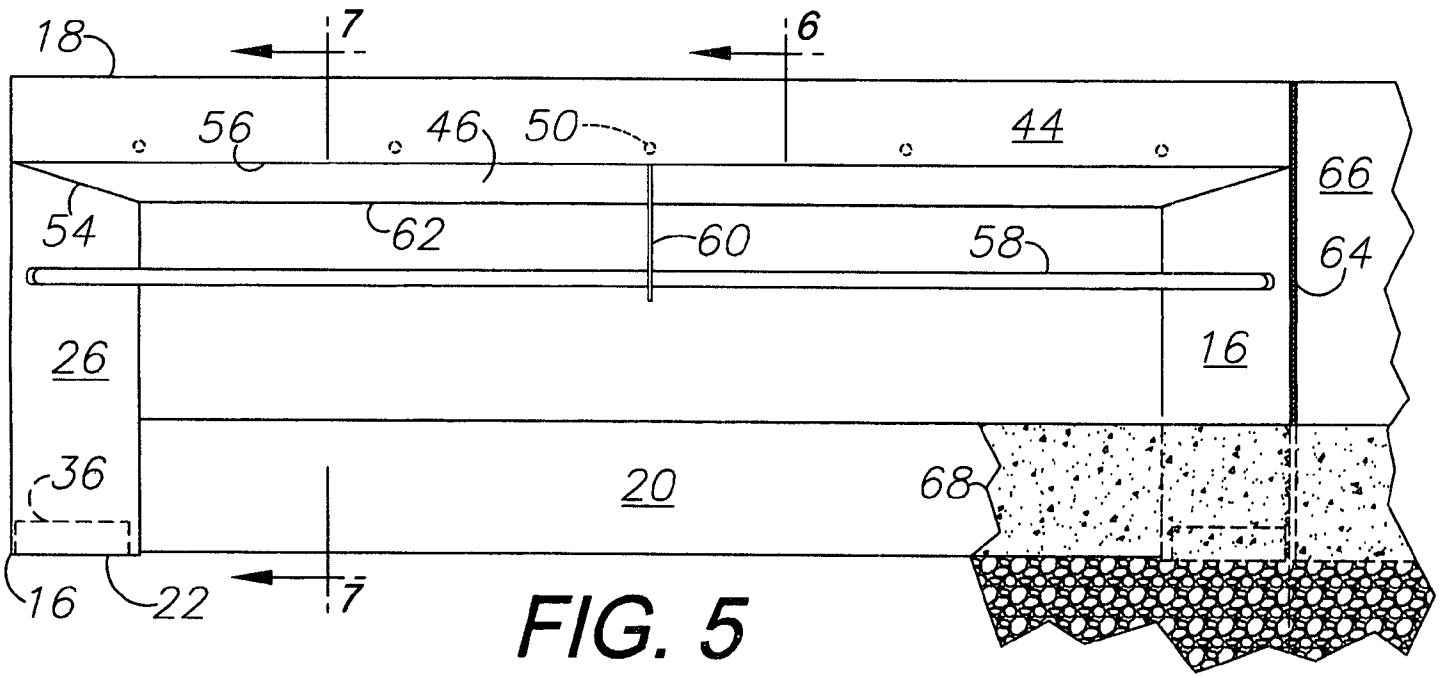
FIG. 5 is a front elevational view thereof.
Figure 12:
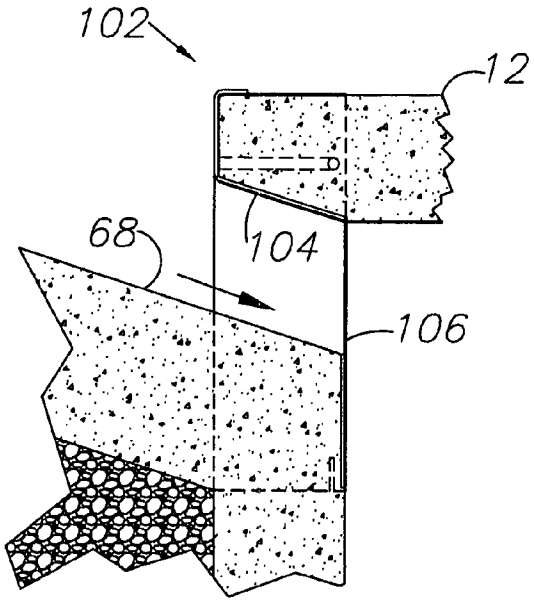
FIG. 12 is an enlarged, cross-sectional view thereof taken generally along line 12-12 in FIG. 11.
Figure 6:
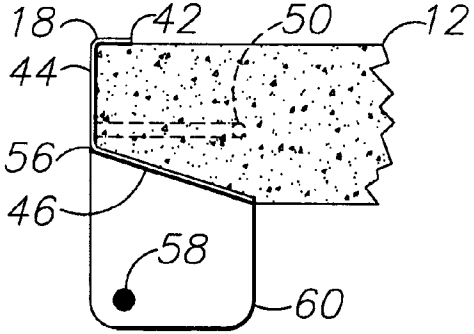
FIG. 6 is an enlarged, cross-sectional view taken generally along line 6 in FIG. 5.

The drain inlet 2 includes a lower crosspiece 20, which can comprise a steel plate. The lower crosspiece 20 extends between the inside panel rear edges 27 at their lower ends. An upper crosspiece 18 also extends between and is mounted on the side columns 16. The upper crosspiece 18 is preferably brake-formed or bent from steel plate in a generally channel-shaped configuration with a top flange 42, a front flange 44 and a downwardly-and-rearwardly sloping bottom flange 46. The flanges 42, 44, 46 define a rearwardly-open channel 48. Multiple L-shaped reinforcing bars 50 are welded to the front flange 44 rear face and protrude rearwardly from the channel 48. Upper crosspiece ends 52 overlie the side column outside panels 24 at the top and front flanges 42, 44. Each upper crosspiece end 52 is angled inwardly and rearwardly along the bottom flange 46 for welding attachment to a respective inside panel top edge 32 along a welded seam 54. The side column notches 34 accommodate the upper crosspiece ends 52 at a respective fold line 56 between the front and bottom flanges 44, 46 (FIG. 2).

A trash bar 58 extends through the side column inside panel slots 29 and can be welded at its ends to the side column outside panels 24. One or more trash bar hangers 60 can be mounted on the upper crosspiece bottom flange 46 for receiving and supporting the trash bar 58. Suitable numbers of trash bars 58 and hangers 60 can be provided to define maximum opening sizes for a throat 62 of the inlet 2. For example, the inlet 2 may be designed for a maximum clear opening of, for example, six inches in order to prevent children, pets and large debris items from entering the inlet 2. Suitable numbers of trash bars 58 and hangers 60 can be provided to accomplish such design objectives.

Figure 8:
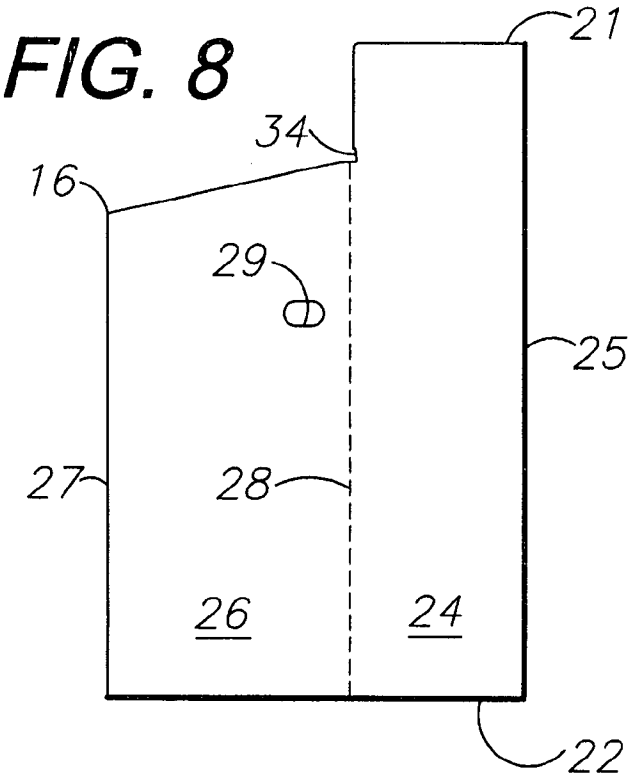
FIG. 8 is an elevational view of a right side column thereof prior to brake-forming to its final configuration.
Figure 9:
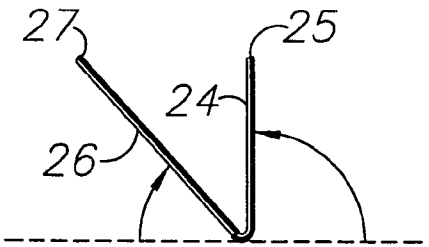
FIG. 9 is a top plan view of the right side column brake-formed in its final configuration.
Figure 10:
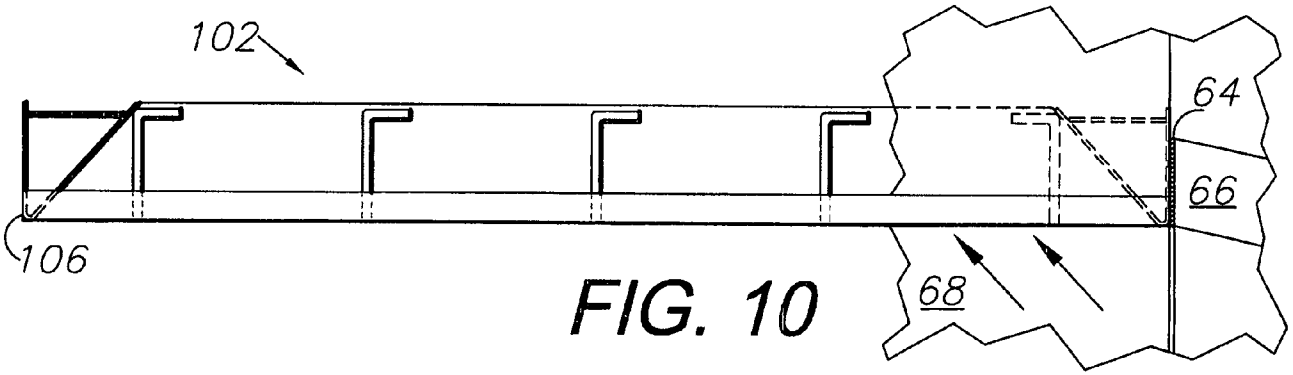
FIG. 10 is a top plan view of a first alternative embodiment drain inlet.
Figure 11:
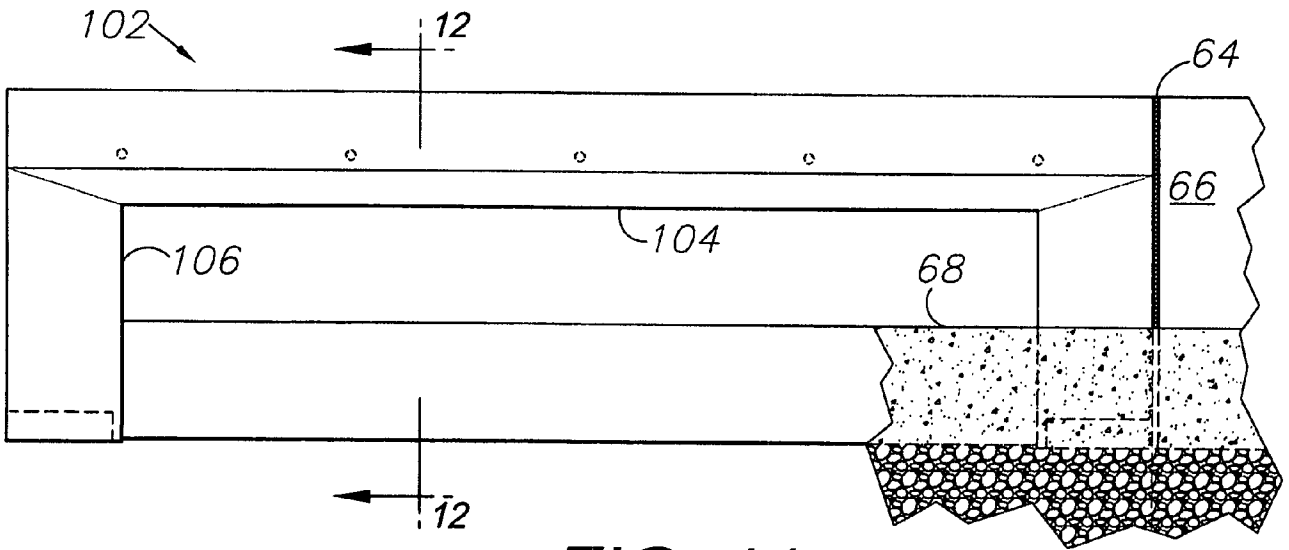
FIG. 11 is a front elevational view thereof.

The inlet 2 can be fabricated from steel plates and formed on conventional brake equipment. For example, the side columns 16 are brake-formed from flat plate cutouts as shown in FIGS. 8 and 9. The inlet 2 can be suitably finished, e.g. by galvanizing, painting or coating. Alternatively, corrosion-resistant materials, such as stainless steel and aluminum, can be used for fabricating the inlet 2. The collection box 4 can be cast-in-place by first forming the bottom (not shown) and walls 6, 8, 10. The inlet 2 can then be positioned on top of the front wall 6 with its side columns 16 engaging the respective side walls 10. In this position the inlet 2 provides part of the formwork for the collection box top 12. For example, forms can be supported by the trash bar 58 along the front of the collection box 4. Suitable reinforcing bars can be positioned behind the upper crosspiece 18 for reinforcing the top 12. The manhole 14 is also placed in position prior to pouring the top 12. The L-shaped reinforcing bars 50 are embedded in the top 12 when it is poured for fixedly connecting it to the upper crosspiece 18. Additional connections can be provided for connecting the inlet 2 to the collection box 4.

Figure 7:
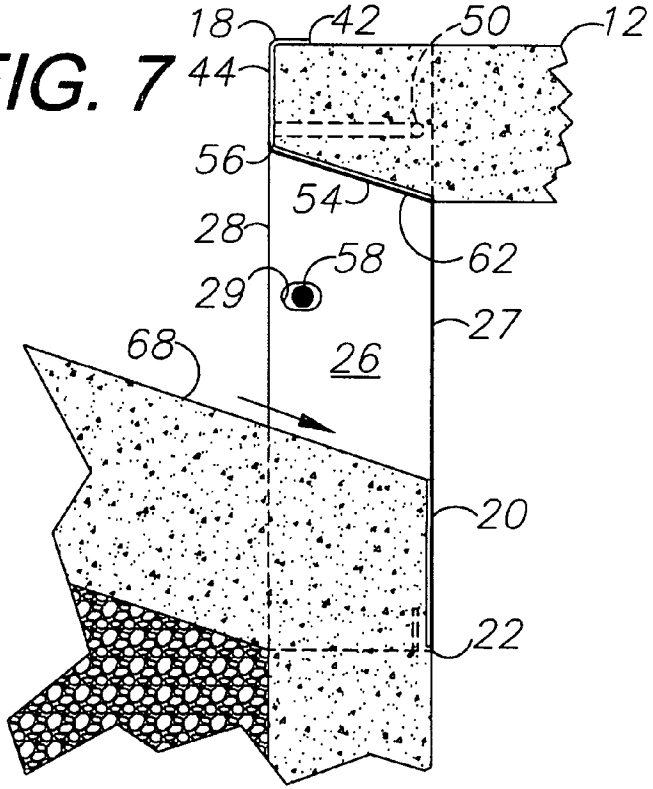
FIG. 7 is an enlarged, cross-sectional view taken generally along line 7-7 in FIG. 5.

With the collection box 4 complete, spacer material 64 can be placed against the side column outside panels 24 for engagement by the adjacent curbs 66 when they are poured. Such spacer material 64 can comprise, for example, expansion joint material, waterproof membranes such as saturated felt, building paper, etc. the spacer material 64 can accommodate relative movement between the curbs 66 and the collection box 4 and its inlet 2. Such movement can associated with, for example, settling, ground movement or impact loads. By accommodating such relative movement, cracks and other types of damage to the concrete portions of the collection box 4 can be reduced. The useful lives of the structures can thereby be lengthened. In conjunction with pouring the curbs 66, an apron 68 can be poured with a suitable downward slope into the throat 62, with the lower crosspiece 20 providing a rear form for providing the proper horizontal elevation for the rear edge of the apron 68 (FIG. 7). Prefabricating the inlet 2 off-site can expedite construction because the other components of the collection box 4 can be poured-in-place with common concrete construction techniques, materials and equipment. The entire collection box 4 can also be prefabricated off-site. Storm drainage from the surrounding area is facilitated by the rearwardly-converging configuration of the throat 62, which is defined by the converging inside panels 26 and the sloping crosspiece bottom flange 46. Storm drainage is thus diverted past the trash bar 58, into the throat 62 and then into the collection box 4. Large debris is preferably caught by the trash bar 58 at the outside of the throat 62, whereat trash removal is relatively easy.

Figure 13:
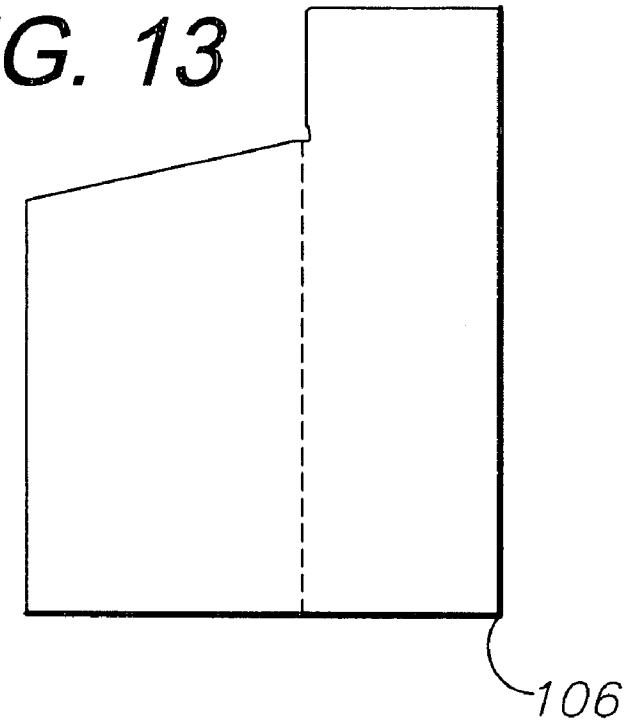
FIG. 13 is an elevational view of a right side column thereof prior to brake-forming to its final configuration.
Figure 14:
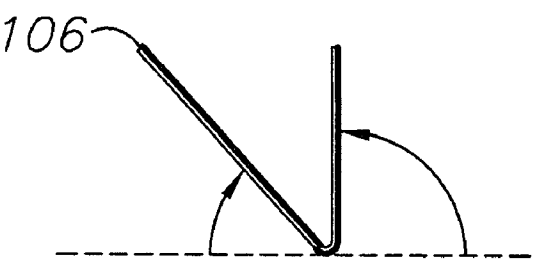
FIG. 14 is a top plan view of the right side column brake-formed in its final configuration.
Figure 15:
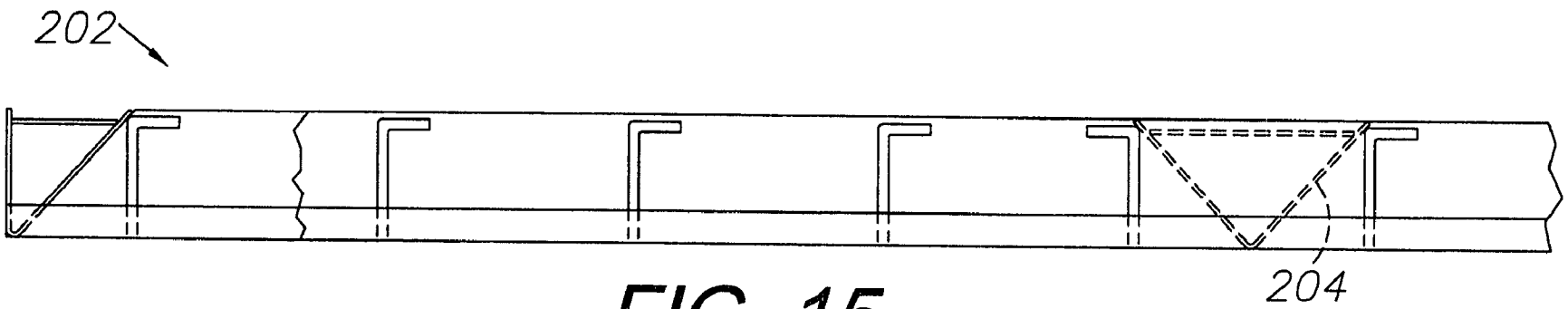
FIG. 15 is a top plan view of another alternative embodiment storm drain inlet.
Figure 16:
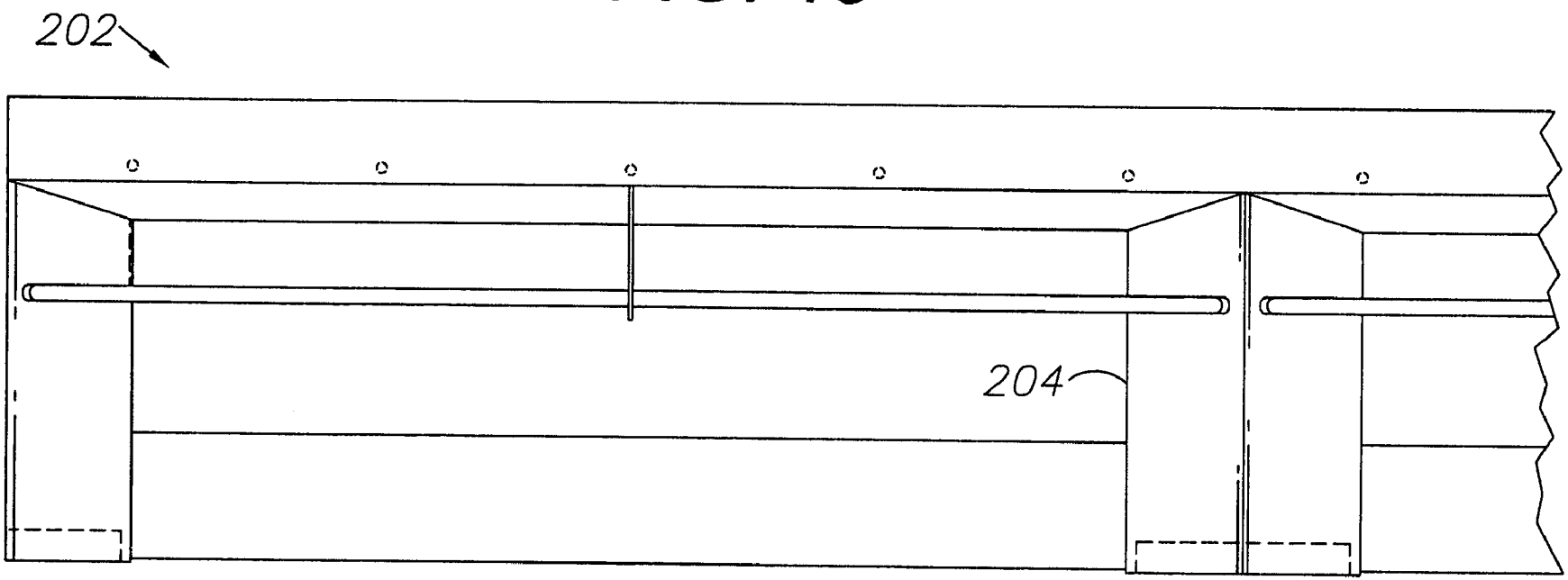
FIG. 16 is a front elevational view thereof.

FIGS. 10-14 show an alternative embodiment inlet 102 with a reduced-height throat 104, which eliminates the need for a horizontal trash bar. The overall height of the inlet 102 can be correspondingly reduced, as compared to the inlet 2. As shown in FIGS. 13 and 14, side columns 106 can be brake-formed substantially similar to the side columns 16 described above, with shorter overall heights and without the trash bar slots 29.

Figure 17:
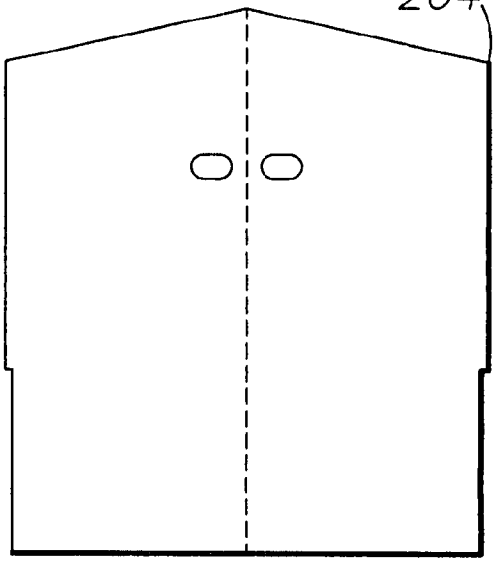
FIG. 17 is an elevational view of a center column thereof prior to brake-forming to its final configuration.
Figure 18:
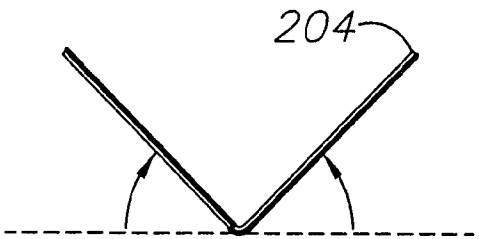
FIG. 18 is a top plan view of the center column brake-formed in its final configuration.
Figure 19:
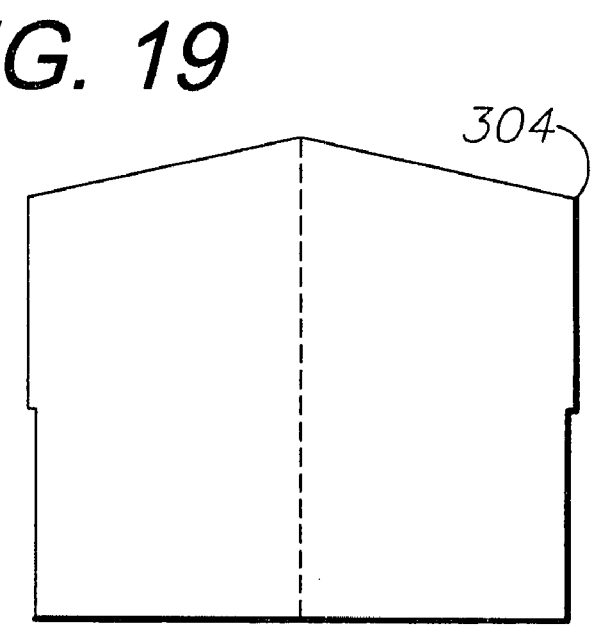
FIG. 19 is an elevational view of a center column for an alternative embodiment low-profile drain inlet prior to brake-forming to its final configuration.
Figure 20:
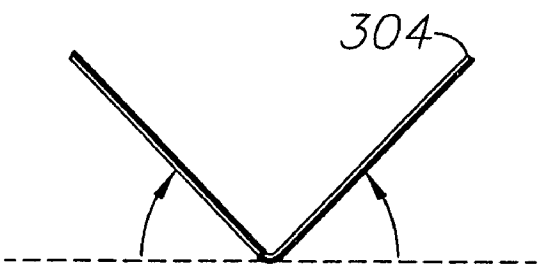
FIG. 20 is a top plan view of the center column brake-formed in its final configuration.

FIGS. 15-18 show another alternative embodiment inlet 202, which is similar to the inlet 2 except wider to accommodate wider collection boxes. The extra width is accommodated by a medial column 204, which can be installed in multiples to form relatively wide inlets. As shown in FIGS. 17 and 18, the medial column 204 can be brake-formed like the side columns 16. FIGS. 19 and 20 show a medial column 304 adapted for an extended-width, reduced-height inlet with a construction similar to the inlet 102, which can accommodate a reduced-height medial column 304 in order to provide greater width.

It is to be understood that the invention can be embodied in various forms, and is not to be limited to the examples discussed above. Other components and configurations can be utilized in the practice of the present invention.

Having thus described the invention, what is claimed as new and desired to be secured by Letters Patent is:

1. A drain inlet for a storm drain collection box including front and rear walls, opposite side walls and a top, said storm drain collection box being adapted for location generally between two curb sections and behind an apron, which inlet includes:

a pair of side columns each having upper and lower ends;

each said side column having inside and outside panels connected along a vertical front fold line and forming an acute dihedral angle for forming a front edge of said side column;

each said outside panel being generally flush with and parallel to a respective collection box side wall and thereby defining a flush side of said box against which said top can be poured;

said inside panels converging generally rearwardly and inwardly with respect to said collection box and having respective top edges for directing storm water into said box;

a crosspiece connected to and forming a front edge of said collection box top and extending between said side columns, said crosspiece having opposite ends connected to said side column upper ends;

said crosspiece including a bottom flange mounted on said inside panel upper edges;

said side columns and said crosspiece bottom flange forming an inlet throat converging into said collection box;

each said side column outside panel having an upper edge at said side column upper end;

each said side column inside panel having an upper edge located below said outside panel upper edge; and each said side column inside panel upper edge being connected to said bottom flange at a respective crosspiece end.

2. The inlet according to claim the 1, which includes: said crosspiece comprising an upper crosspiece; and a lower crosspiece extending between said side column inside panels and providing a back form for said apron.

3. The inlet according to claim 2, which includes:

a medial column comprising a pair of panels folded along a medial column fold line located at the front of said inlet; and said medial column being connected to said upper and lower crosspieces intermediate said side columns.

4. The inlet according to claim 1, which includes:

said crosspiece including a top flange mounted on said outside panel upper edges, said crosspiece including a front flange mounted cm said outside panels below the upper edges thereof; and said crosspiece bottom flange sloping rearwardly and downwardly from said front flange and having converging edges each aligned with and connected to a respective inside panel upper edge.

5. The inlet according to claim to 4, which includes:

each said side column outside panel having a respective notch located above said fold line and said inside panel upper edge; and each said notch receiving a portion of a respective said crosspiece end.

6. The inlet according to claim 1, which includes:

a trash bar extending across said throat and having opposite ends each mounted on a respective side column.

7. The inlet according to claim 6, which includes:

a trash bar hanger mounted on said crosspiece and depending downwardly therefrom; and said trash bar banger including a receiver receiving said trash bar.

8. The inlet according to claim 1, which includes:

each said side column outside panel being located adjacent to a respective curb sections; and a pair of spacers each located between a respective side column outside panel and a respective curb section and adapted for accommodating relative movement therebetween.

9. The drain inlet according to claim 1, which includes:

multiple reinforcing bars mounted on and extending rearwardly from said crosspiece; and said reinforcing bars being embedded in said collection box top.

10. A drain inlet for a storm drain collection box including front and rear walls, opposite side walls and a top, said storm drain collection box being adapted for location generally between two curb sections and behind an apron, which inlet includes:

a pair of side columns each having upper and lower ends;

each said side column having inside and outside panels connected along a vertical front fold line and forming an acute dihedral angle for forming a front edge of said side column;

each said outside panel being generally (flush with and parallel to a respective collection box side wall and thereby defining a flush side of said box against which said top can be poured;

said inside panels converging generally rearwardly and inwardly with respect to said collection box and having respective top edges for directing storm water into said box;

an upper crosspiece connected to said collection box top and extending between said side columns, said crosspiece having opposite ends connected to said side column upper ends;

said upper crosspiece including a bottom flange mounted on said inside panel upper edges;

said side columns and said crosspiece bottom flange forming an inlet throat converging into said collection box;

each said side column outside panel having an upper edge at said side column upper end;

each said side column inside panel having an upper edge located below said outside panel upper edge;

each said side column inside panel upper edge being connected to said bottom flange at a respective upper crosspiece end;

said upper crosspiece including a top flange mounted on said outside panel upper edges, said upper crosspiece including a front flange mounted on said outside panels below the upper edges thereof;

said upper crosspiece bottom flange sloping rearwardly and downwardly from said front flange and having converging edges each aligned with and connected to a respective inside panel upper edge;

a lower crosspiece extending between said side column inside panels and providing a back form for said apron;

a medial column comprising a pair of panels folded along a medial column fold line located at the front of said inlet;

said medial column being connected to said upper and lower crosspieces intermediate said side columns;

each said side column outside panel having a respective notch located above said fold line and said inside panel upper edge;

each said notch receiving a portion of a respective said crosspiece end;

a trash bar extending across said throat and having opposite ends each mounted on a respective side column;

a trash bar hanger mounted on said crosspiece and depending downwardly therefrom;

said trash bar banger including a receiver receiving said trash bar;

each said side column outside panel being located adjacent to a respective curb section;

a pair of spacers each located between a respective side column outside panel and a respective curb section and adapted for accommodating relative movement therebetween;

multiple reinforcing bars mounted on and extending rearwardly from said crosspiece; and said reinforcing bars being embedded in said collection box top.

* * * * *